US005301092A

United States Patent [19]

Santosuosso et al.

[11] Patent Number: 5,301,092

[45] Date of Patent: Apr. 5, 1994

[54] DISPLAY CASE WITH LENS LIGHTING SYSTEM

[75] Inventors: Joseph R. Santosuosso, Chatsworth; Richard J. Richardson, Simi Valley; Wal M. Liu, West Covina; Dusan Pope, Santa Clarita; Artak Ter-Oganesian, Glendale; Andrew Y. A. Chao, Baldwin Park, all of Calif.

[73] Assignee: Anthony's Manufacturing Company, Inc., San Fernando, Calif.

[21] Appl. No.: 32,349

[22] Filed: Mar. 12, 1993

Related U.S. Application Data

[63] Continuation of Ser. No. 865,096, Apr. 8, 1992, abandoned.

[51] Int. Cl.[5] ..... A47F 11/10

[52] U.S. Cl. ..... 362/125; 362/133; 362/224; 362/329; 312/223.5

[58] Field of Search ..... 362/125, 133, 223, 224, 362/260, 299, 343, 328, 329; 312/223.5

[56] References Cited

U.S. PATENT DOCUMENTS

| | | | |
|---|---|---|---|
| 2,248,638 | 7/1941 | Merton | 359/592 |
| 2,293,924 | 8/1942 | Swanson | 362/223 |
| 2,476,352 | 7/1949 | Bissell et al. | 362/223 |
| 2,533,661 | 12/1950 | Arenberg et al. | 362/355 X |
| 2,551,710 | 5/1951 | Slaughter . | |
| 2,563,635 | 8/1951 | Askin | 362/223 |
| 2,583,939 | 1/1952 | French et al. | 362/223 |
| 2,807,710 | 9/1957 | Williams | 362/223 |
| 3,242,331 | 3/1966 | Behringer et al. | 362/223 |
| 3,808,495 | 4/1974 | Win | 313/110 |
| 4,017,130 | 4/1977 | Hanson | 312/223.5 X |
| 4,390,930 | 6/1983 | Herst et al. | 362/224 |
| 4,393,323 | 7/1983 | Hubner | 313/110 |
| 4,432,044 | 2/1984 | Lautzenheiser | 362/223 |
| 4,450,509 | 5/1984 | Henry | 362/216 |
| 4,496,216 | 1/1985 | Cowan | 354/200 |
| 4,609,978 | 9/1986 | Hsieh et al. | 362/335 |
| 4,611,266 | 9/1986 | Schwartz | 362/226 |
| 4,660,934 | 4/1987 | Akiba et al. | 430/299 |
| 4,734,836 | 3/1988 | Negishi | 362/311 |
| 4,792,197 | 12/1988 | Inoue et al. | 350/3.7 |
| 4,793,680 | 12/1988 | Byron | 350/96.19 |
| 4,806,454 | 2/1989 | Yoshida et al. | 430/321 |
| 4,858,087 | 8/1989 | Hartshorn | 362/219 |
| 4,924,368 | 5/1990 | Northrop et al. | 362/376 |
| 4,979,078 | 12/1990 | Amstutz et al. | 362/125 |
| 4,997,747 | 3/1991 | Yoshida et al. | 430/321 |
| 5,016,146 | 5/1991 | Kaspar | 362/92 |
| 5,022,720 | 6/1991 | Fevig et al. | 312/223 |
| 5,034,861 | 7/1991 | Sklenak et al. | 362/133 X |
| 5,080,465 | 1/1992 | Laude | 359/371 |
| 5,116,461 | 5/1992 | Lebby et al. | 156/643 |

FOREIGN PATENT DOCUMENTS 75555 3/1986 Taiwan .

OTHER PUBLICATIONS

Book: Eugene Hecht and Alfred Zajac, Addison-Wesley Publishing Company, Inc., *Optics*, "Geometrical Optics," pp. 108-110 and 167-169, Redding, Massachusetts, 1979.

Book: Laurin Publishing Co., *The Photonics Dictonary*, p. D-23, Pittsfield, Massachusetts, 1991.

Paper: Technical Education Research Center-SW, "Course VI Laser and Electro-Optic Components," pp. 20-21, Waco, Texas, Aug. 1980.

*Primary Examiner*—Stephen F. Husar

*Attorney, Agent, or Firm*—Poms, Smith, Lande & Rose

[57] ABSTRACT

A display case having lenses mounted in the case that distribute or direct light emitted by fluorescent tubes located near the ends of display shelves toward the shelves in order to provide a more uniform light distribution along the length of the shelves. The lenses facilitate the illumination of items placed on the shelves near the front and middle of the shelves. Light-directing portions of the lenses distribute or direct light emitted from the fluorescent tubes located inside the lenses toward the display case shelves.

20 Claims, 5 Drawing Sheets

DISPLAY CASE WITH LENS LIGHTING SYSTEM

This is a continuation of copending application Ser. No. 07/865,096 filed on Apr. 8, 1992, now abandoned.

CROSS-REFERENCE TO RELATED APPLICATION

The subject matter of this application is related to the subject matter of copending application, filed with the present application, entitled "DISPLAY CASE WITH SHAPED LIGHTED SHELVES," assigned to Anthony's Manufacturing Company, Inc., the assignee of the present application.

BACKGROUND OF THE INVENTION

The present invention relates generally to lighted display cases, and more particularly to display cases having light sources that direct light toward the display case shelves.

In the past, a variety of shelves have been used inside display cases for the purpose of displaying different items in supermarkets, or other retail establishments. Items for sale are typically placed on top of the shelves in rows or columns. For example, dairy products in a supermarket may be placed on shelves inside a refrigerated display case with the older dairy products, which need to be sold first, located near the front and middle of the shelves where the products may be easily picked up by customers. However, problems are encountered in lighting such products.

Products located near the middle of display shelves are difficult to light when vertical, fluorescent tubes or other lights located near the ends of the shelves are used to light or illuminate the interior of a display case. In such a case, the products located near the lights receive more light or illumination than products located near the front and middle of the shelves. As a result, products near the middle of the shelves are insufficiently illuminated.

SUMMARY OF THE INVENTION

It is an object of this invention to provide a display case having lenses mounted in the case that alter light distribution along the display case shelves to produce a more uniform light distribution along the length of the shelves.

It is another object of this invention to provide a display case having lenses mounted in the case that direct light toward the shelves in order to more uniformly distribute light along the length of the shelves.

It is still another object of this invention to provide a display case having some display shelves illuminated by lenses mounted in the case, allowing certain items on certain shelves to be illuminated better than other items on other shelves.

It is still another object of this invention to provide a display case having lenses mounted in the case for distributing light that are economical to manufacture.

These and other objects and advantages are obtained by a display case having lenses mounted in the case that distribute or direct light emitted by fluorescent tubes located near the ends of display shelves toward the shelves in order to provide a more uniform light distribution along the length of the shelves. The lenses facilitate the illumination of items placed on the shelves near the front and middle of the shelves. Light-directing portions of the lenses distribute or direct light emitted from the fluorescent tubes located inside the lenses toward the display case shelves.

In one embodiment of the lenses, light-directed portions located on opposite sides of a fluorescent tube are used to direct light toward shelves located on opposite sides of the tube. Another embodiment of the lenses uses only one light-directing portion. Such an embodiment may be used at the end of a shelf located near the side of a display case.

The various features of the present invention will be best understood together with further objects and advantages by reference to the following description of the preferred embodiments take in conjunction with the accompanying drawings.

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventors for carrying out their invention in a commercial environment, although it should be understood that various modifications can be accomplished within the parameters of the present invention.

Figure 1:
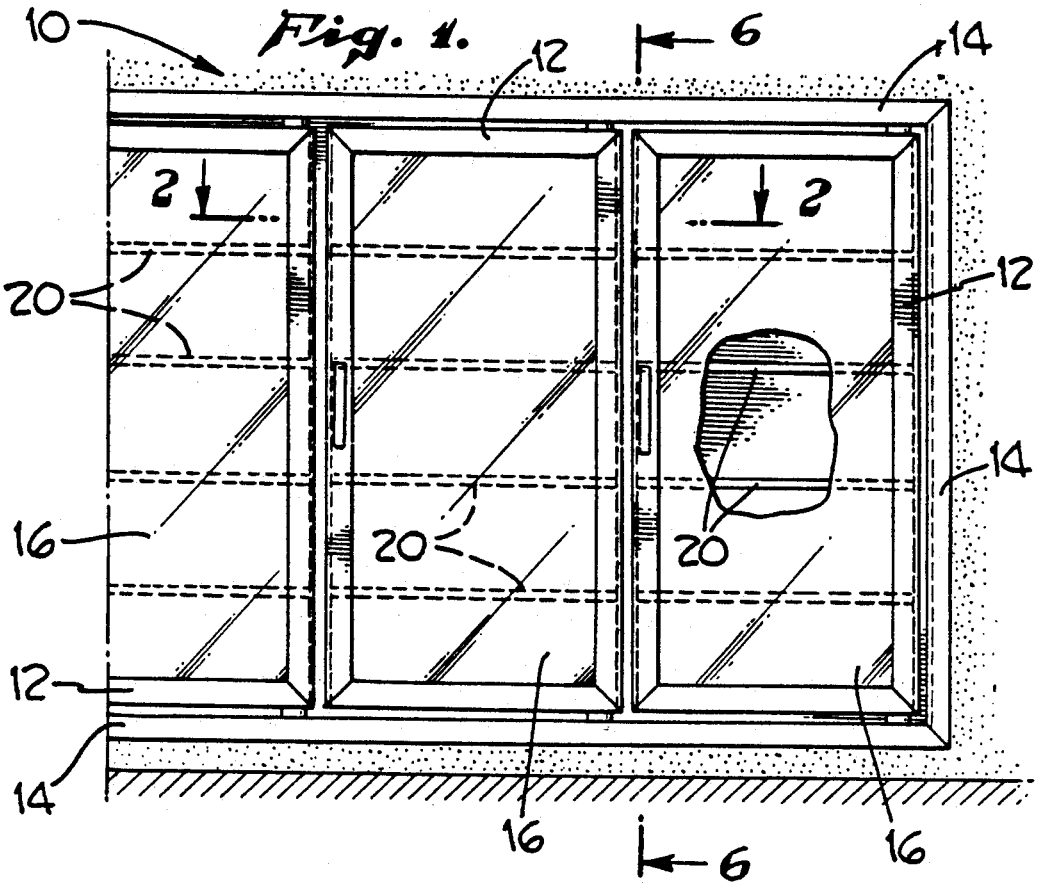
FIG. 1 is an elevational view of a display case of the present invention having doors mounted thereon and shelves mounted inside the case.

Referring to FIG. 1, a display case 10 of the present invention is shown having doors 12 mounted on a surrounding frame 14. The doors 12 have glass panels 16, which allow someone, such as a customer in a supermarket, to look through the panels 16 at items 18 (see FIG. 2) displayed on shelves 20 inside the case 10. The items 18 inside the display case 10 may or may not be refrigerated items 18, such as frozen foods.

Figure 2:
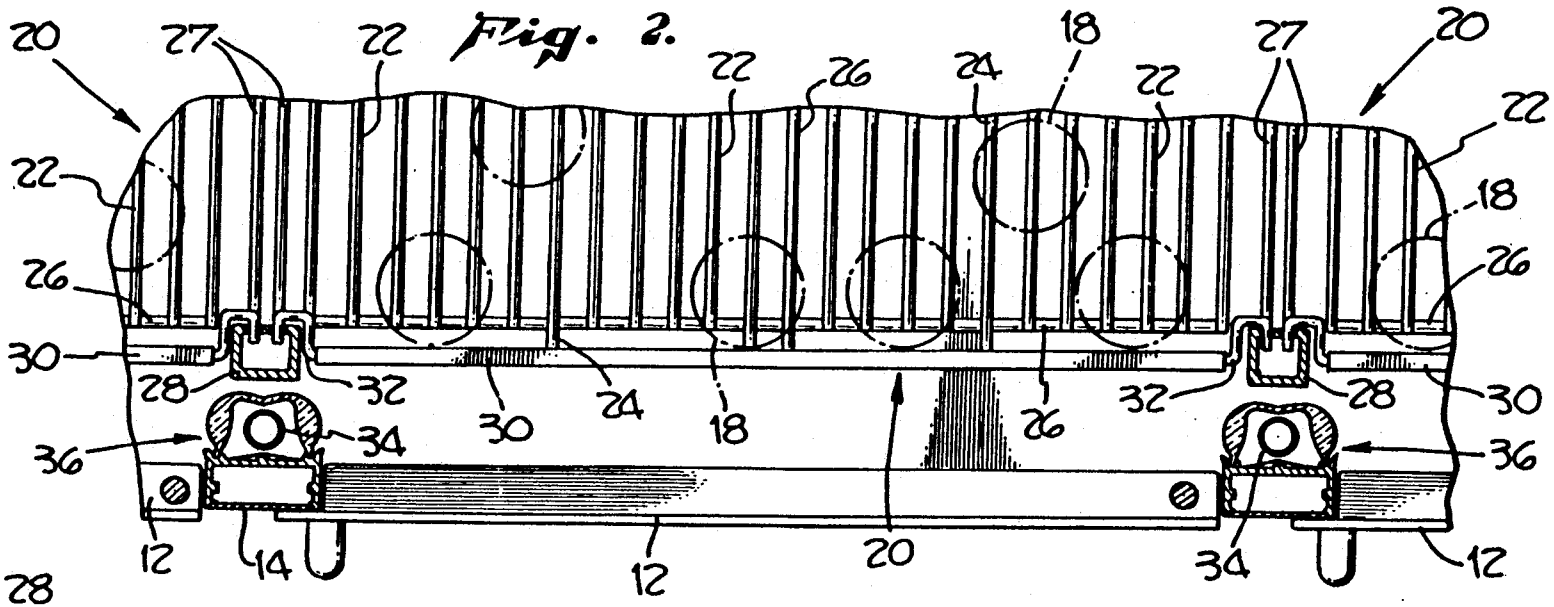
FIG. 2 is a partial cross-sectional view taken in the direction of arrows 2—2 of FIG. 1 showing lenses, for directing light, mounted on a surrounding frame near ends of one of the shelves.

FIG. 2 shows adjacent shelves 20 mounted at the same height or level within the display case 10. Each of the shelves 20 has vertical supporting rods 22 and 24, horizontal supporting rods 26, and end rods 27. The end rods 27 are mounted in column supports 28 and the back wall (not shown) of the display case 10. Front plates 30 are mounted to rods 24 at the front of the shelves 20 and to the column supports 28 by hook members 32. However, any other type of construction may be used for the shelves 20. For example, the shelves 20 may be constructed from sheet metal, may be injection molded, or the like.

As can be seen from FIG. 2, items 18 placed near the front and middle of shelves 20 in the display case 10 are difficult to light or illuminate when vertical fluorescent lights or tubes 34, used to light the case 10, are located near the ends of the shelves 20, or near the front end corners of the shelves 20, as shown in FIG. 2. In such a case, items 18 located near the front of the shelves 20 and close to the fluorescent tubes 34 will be illuminated better than items 18 which are placed farther away from the tubes 34 and near the front and middle of the shelves 20.

Items 18 placed near the front and middle of the shelves 20 are not adequately illuminated by the light emitted from the tubes 34 because light from light sources such as tubes 34 follows the inverse-square law. In other words, as is well known, the illuminance provided to each item 18 located along the front of one of the shelves 20 by a light source (tube 34) will be inversely proportional to the distance between the item 18 on the shelf 20 and the light source. In addition, the angle of incidence at which light rays strike the items 18 will be greater for items 18 located near the tubes 34 than for items 18 located near the front and middle of the shelves 20. Therefore, more light will be reflected toward the eyes of customers from items 18 near the tubes 34. As a result, items 18 located near the fluorescent tubes 34 will be illuminated better than items 18 located near the front and middle of the shelves 20. The present invention provides better lighting or illumination, or a more uniform lighting distribution along the length of the shelves 20, and provides more illumination for items 18 located near the front and middle of the shelves 20 than they would otherwise receive without the lens 36 of this invention.

FIG. 2 shows lenses 36 mounted on the frame 14 of the display case 10 near the ends or front end corners of the display shelves 20. The lenses 36 are mounted about the fluorescent tubes 44 and are used to direct light beams 38 toward the shelves 20 (see FIG. 5) in order to provide better lighting or illumination for items 18 located near the front and middle of the shelves 20, and to distribute the light more uniformly along the length of the shelves 20.

Figure 3:
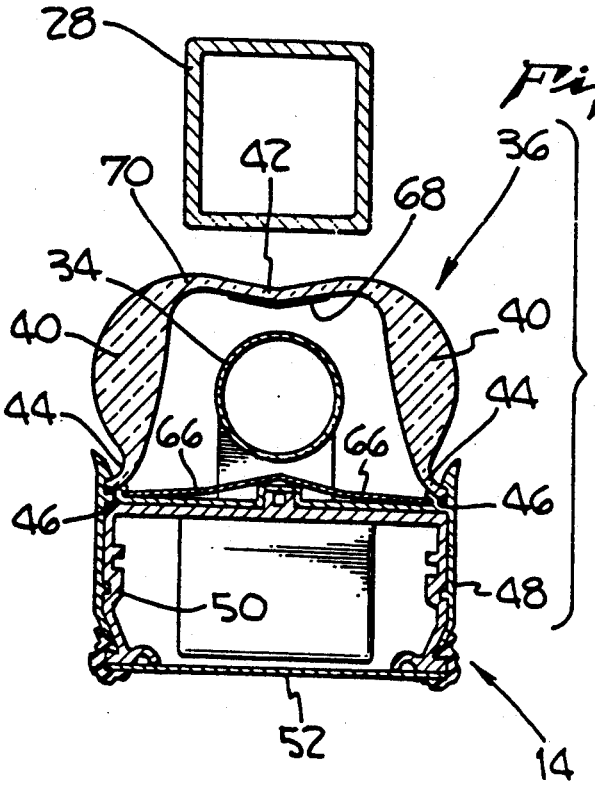
FIG. 3 is an enlarged cross-sectional view taken like FIG. 8, showing one of the lenses mounted on the frame, surrounding a fluorescent light tube.

Referring to FIG. 3, each lens 36 has light-directing portions 40, connected by a top portion 42, which are located on opposite sides of one fluorescent tube 34. The lens 36 is mounted to the frame 14 by end portions 44 which releasably engage channels 46 in a mullion cover 48 which is connected to a mullion 50 of the frame 14. The lens 36 is sufficiently flexible to allow end portions 44 to releasably engage channels 46. A front plate 52 is attached to the mullion 50. However, only one light-directing portion 40 may be used for the lens 36, if shelves 20 on only one side of the tube 34 are to be illuminated (see FIG. 9).

Figure 5:
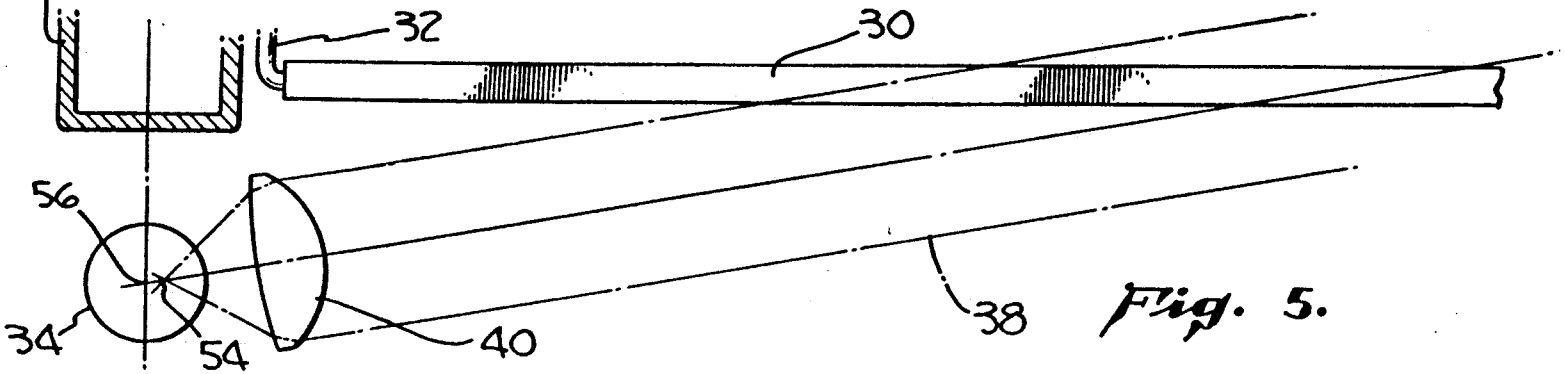
FIG. 5 is an enlarged, partial cross-sectional view showing portions of the surrounding frame and of a shelf, and schematically how the light-directing portion of one of the lenses directs light toward the shelf in order to more uniformly distribute light along the length of the shelf.

The light-directing portions 40 of the lenses 36 are designed to direct light beams 38 toward the shelves as illustrated in FIG. 5, or to alter the light distribution along the length of the shelves 20 in a manner which shifts an amount of the light nearer the light source (tubes 34) to areas located farther from the light source. Preferably, the lens 36 is designed and mounted on the frame 14 so that the focal point 54 of each of the light-directing portions 40 of the lens 36 approximately falls on, or is coaxial with, the longitudinal axis of the fluorescent tube 34 surrounded by the lens 36. When so designed, light rays emitted by the tube 34 will be focused as substantially parallel light rays, or collimated light, directed along the length of the shelf 20 in a light beam 38 focused as substantially parallel light rays (see FIG. 5). As a result, the focused, substantially parallel light beam 38 will not follow the inverse-square law, and items 18 located near the front and middle of the shelf 20 will be adequately illuminated. The lens 36 may be designed to produce any desirable width for the beam 38.

Figure 4:
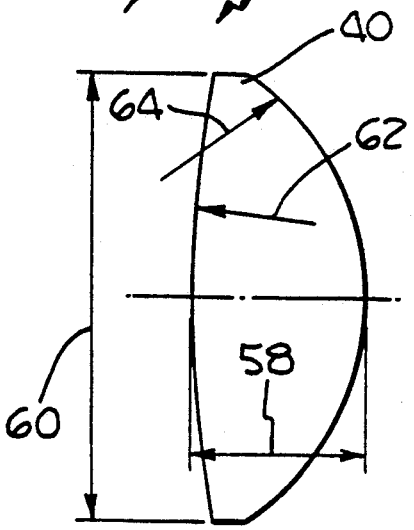
FIG. 4 is a schematic view representing a portion of one of the lenses used to direct light.

A schematic representation of one of the light-directing portions 40 is shown in FIG. 4. As illustrated, portion 40 is a convex, or positive lens. For a fluorescent tube 34 having a diameter of approximately 1.0 inch and a shelf length of approximately 3.0 feet, the light-directing portion 40 would preferably have a central thickness 58 of about 0.55 inches, an edge diameter 60 of about 1.3967 inches, an inner surface radius 62 of about 3.9646 inches, and an outer surface radius 64 of about 0.8199 inches. However, the dimensions of the light-directing portion 40 may be varied as desired to meet the lighting requirements of different size shelves 20, tubes 34, or display cases 10.

The lens 36 is preferably made out of acrylic or plastic having an index of refraction ($N_d$) of 1.4917, and an Aberration (or Abbey) No. (V) of 57.2. However, any suitable optical material may be used for the lens 36 such as glass, or the like.

One advantage of the present invention is that the lens 36 is relatively compact, and may be easily fit between the frame 14 and columns 32. Parabolic reflectors may be used to direct parallel light rays. However, it would be difficult to fit larger size parabolic reflectors between the frame 14 and columns 32.

Referring again to FIG. 3, reflectors 66 may be mounted on the mullion cover 48 under the fluorescent tube 34 in order to reflect light upward or toward the light-directing portions 40. A reflector 68 may also be attached to top portion 42 of the lens 36 to prevent too much light from exiting through the top of the lens 36, eliminating bright or hot spots near the ends of the shelves 20. The reflector 68, which may be a reflective coating or a reflecting tape, or the like, reflects light downward and toward portions 40. Alternatively, part of top portion 42 of the lens 36 may be glazed or otherwise prepared to prevent too much light from escaping or exiting through the top of the lens 36, or in order to diffuse light passing through the lens 36. Preferably, intermediate top portions 70 of the lens 36, between top portion 42 and the light-directing portions 40, are not glazed or covered by reflector 68 (as shown in FIG. 3) in order to allow some light to exit the top of the lens 36 for the purpose of lighting the shelves 20 near the columns 28.

FIG. 3 shows a transverse cross-section of the lens 36. The lens 36 may have a longitudinal length approximating the longitudinal length of the tube 34 it surrounds (see FIG. 6), or may be comprised of a number of shorter longitudinal segments or lengths having a combined length equalling that of the tube 34. Also, the lights 34 may be a number of separate tubes used for each level of shelves, or other types of lights used at different heights of the display case 10. For example, a shorter version of the lens 36 may be used with a spherical-shaped bulb instead of a tube.

It is intended that lens 36, as used herein, refers to any lens that directs or distributes light from a light source, such as tube 34, more uniformly over the length of a shelf. The light beam directed by the lens does not have to be a focused, substantially parallel light beam like beam 38 shown in FIG. 5.

The lenses 36 direct light toward the shelves 20, and more uniformly distribute light along the length of the shelves 20, or better illuminate items 18 placed toward the middle of the shelves 20. If lenses 36 are used at both ends of a shelf 20, then the corresponding light-directing portions 40 of both lenses 36 at the opposite ends of the shelf 20 will both direct light along the length of the shelf 20, combining to increase the illuminance along the shelf length and near the middle of the shelf 20. As such, the light-directing portions 40 of each lens 36 direct light toward adjacent shelves 20, or toward shelves 20 on both sides of the lens 36.

Figure 10:
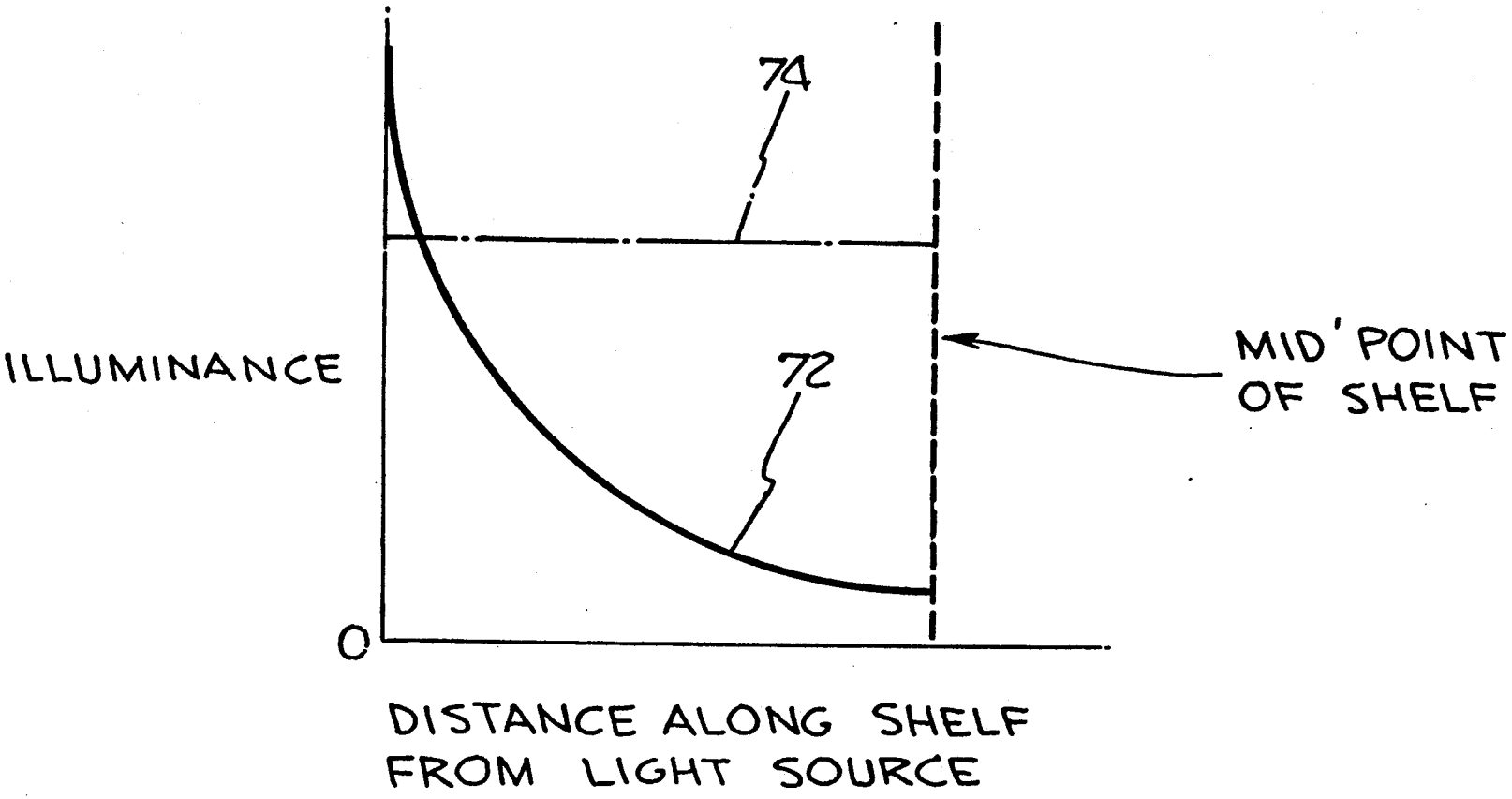
FIG. 10 is a graph schematically representing how light is distributed along the length of a shelf from a light source, such as a fluorescent light tube, located at one end of the shelf, and ideally distributed uniformly along the length of the shelf.

FIG. 10 is a graph schematically representing how light is distributed along the length of the shelf 20 by one of the tubes 34 located at one end of the shelf 20 following the inverse-square law (graph 72). Graph 74 shown in FIG. 13 ideally represents a uniform light distribution over the shelf 20 that is the goal of the present invention.

Figure 6:
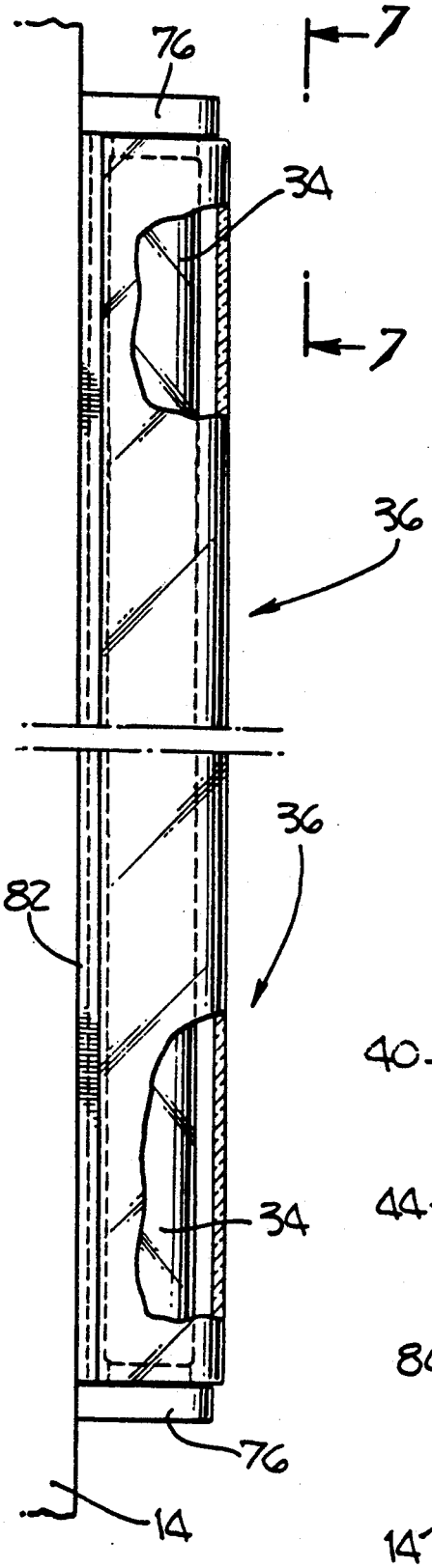
FIG. 6 is a side elevational view of upper and lower portions of one of the lenses shown surrounding a vertically-oriented fluorescent tube (middle portions of the lens and tube being omitted)
Figure 7:
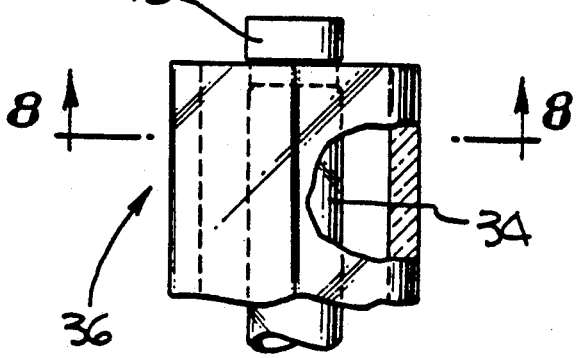
FIG. 7 is an enlarged, detailed front view of the upper end of the lens of FIG. 6.

FIGS. 6 and 7 show how the elongated lens 36 fits around the fluorescent tube 34 which is connected to sockets 76 at the ends of the tube 34.

Figure 8:
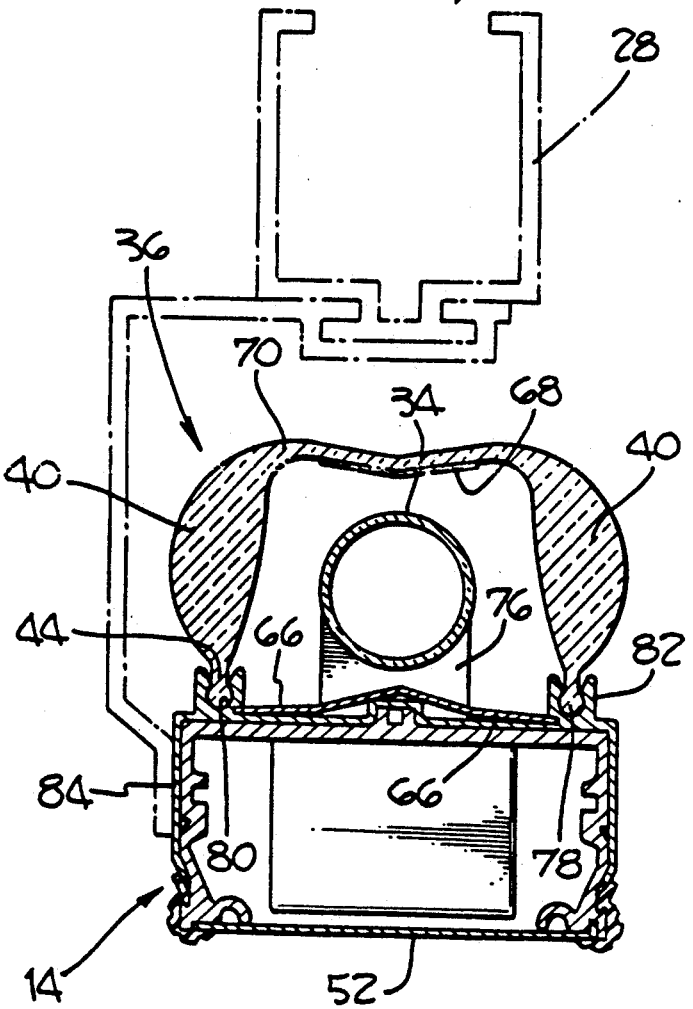
FIG. 8 is an enlarged cross-sectional view of another embodiment of the lens taken in the direction of arrows 8—8 shown in FIG. 7.

FIG. 8 shows the preferred embodiment of the lens 36 having elongated cylindrical portions 78, attached to end portions 44, that engage elongated apertures 80 in elongated extensions 82 of mullion cover 84. The lens 36 is sufficiently flexible to allow portions 78 to engage apertures 80.

It is important to note that any desirable means may be used to attach the end portions 44 of the lens 36 to the mullion cover 84. It is intended that the present invention not be limited by the means used to attach the lens 36 to the mullion covers 48 and 84, or to the surrounding frame 14.

Figure 9:
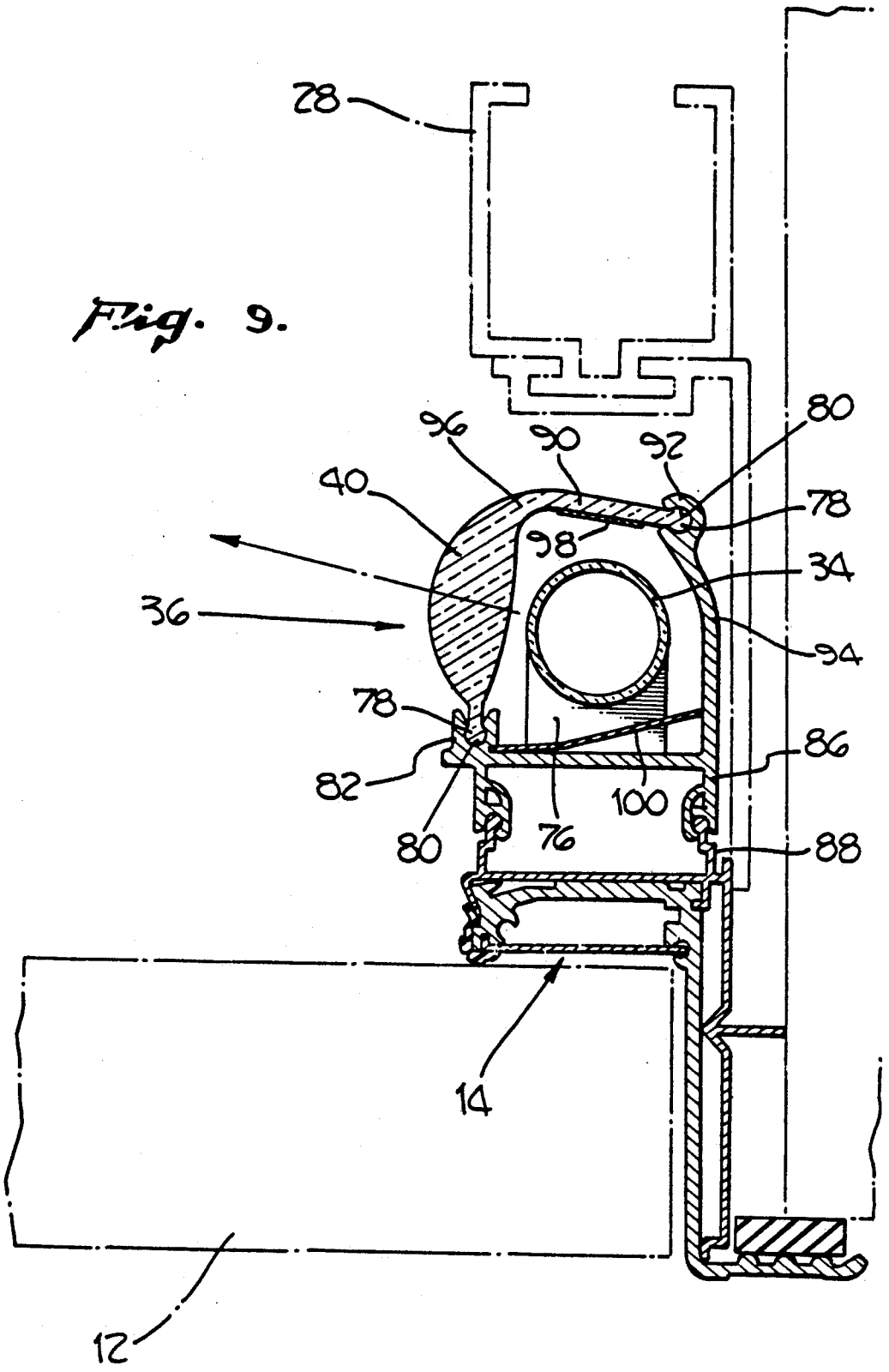
FIG. 9 is an enlarged cross-sectional view of another embodiment of the lens taken like FIG. 8 having only one light-directing portion.

FIG. 9 shows another embodiment of the lens 36 having only one light-directing portion 40. Such a lens design may be used, for example, near the end of a shelf 20 located adjacent the side of the display case 10, or if it is desirable to direct light only toward one of two adjacent shelves 20.

Light-directing portion 40 has end portion 44 with elongated cylindrical portion 78 which engages elongated aperture 80 in elongated extension 82 of mullion cover 86 attached to mullion 88. Portion 40 also has an elongated end portion 90 with elongated cylindrical portion 78 which engages elongated aperture 80 in elongated extension 92 of an upright portion 94 of the cover 86.

The lens 36 of FIG. 9 preferably has reflectors 98 and 100. Reflector 100 directs light toward portion 40, and reflector 98 prevents light from exiting through elongated end portion 90 of the lens 36 and causing bright spots near the end of the shelf 20. However, reflector 98 is sized so as to not cover portion 96 of the lens 36 between portions 40 and 90, allowing sufficient light to exit through portion 96 for the purpose of lighting or illuminating the end of the shelf 20. As discussed above, elongated end portion 90 may be glazed or otherwise prepared to diffuse light through portion 90, if desired.

The lens design shown in FIG. 9 may be used in any combination with the lens designs shown in FIGS. 3 and 8. As such, any combination of features disclosed in this application may be combined in any desirable manner.

In the case of display cases that do not use lenses like the lens 36 of the present invention, the front portions of items positioned near the front and middle of display shelves, such as the flat front sides of box-shaped containers, will not be adequately illuminated by lights such as fluorescent tubes located at the ends of the shelves.

The display case 10 may have some shelves 20 that use lenses 36, and other shelves 20 for which lenses 36 are not used. As a result, certain items 18 on some of the shelves 20 will be lighted better than other items 18 on other shelves 20. This may be desirable, for example, if a store owner wishes to draw customers' attention to the items that are illuminated better by the lenses 36. Also, it may be desirable to provide better lighting for more popular items 18 located on waist-high shelves 20 within easy reach of customers. Less popular items 18 may be placed on the shelves that do not use lenses 36. Also, some of the adjacent shelves at the same height or level in the display case 10 (having more than one door 12) may use lenses 36, and some may not use lenses 36.

It is important to point out that the fluorescent tubes 34 and lenses 36 do not have to be located exactly at the ends of the shelves 20 of the display case 10. As such, the tubes 34 and lenses 36 may be moved closer to or farther away from the middle of the shelves 20. In addition, the fluorescent tubes 34 and lenses 36 may be mounted on any part of the display case 10.

The above description discloses the preferred embodiment of the present invention. However, persons of ordinary skill in the art are capable of numerous modifications once taught these principles. Accordingly, it will be understood by those skilled in the art that changes in form and details may be made to the above-described embodiment without departing from the spirit and scope of the invention.

We claim:

1. A display case used for displaying items, said display case comprising:

a surrounding frame;

shelves mounted inside said display case, at least one of said shelves having a light mounted near one end thereof; and a lens mounted inside said display case and about said light at said one end of said one shelf in order to direct light emitted from said light toward said one shelf in order to provide a more uniform light distribution over the length of said one shelf than would exist without said lens.

2. The display case of claim 1 wherein said one shelf has lights located near both ends thereof and near front end corners of said one shelf.

3. The display case of claim 1 wherein said lens includes a light-directing portion that directs light into a beam of substantially parallel light rays.

4. The display case of claim 2 wherein said lights are fluorescent tubes.

5. The display case of claim 3 wherein said light-directing portion has a focal point that is substantially coaxial with a longitudinal axis of said light.

6. The display case of claim 1 wherein said lens includes two light-directing portions and each of said two light-directing portions has a focal point that is substantially coaxial with a longitudinal axis of said light.

7. The display case of claim 6 wherein said lens is plastic and flexible, and said light-directing portions have end portions that releasably engage apertures in said frame.

8. The display case of claim 1 wherein said lens provides a substantially uniform light distribution across said shelf.

9. A display case used for displaying items, said display case comprising:

a surrounding frame;

shelves mounted inside said display case, at least one of said shelves having lights mounted along ends thereof; and means mounted inside said display case and about one of said lights at each end of said one shelf for directing light emitted from said one light toward said one shelf in order to provide a more uniform light distribution over the length of said one shelf than would exist without said means.

10. The display case of claim 9 wherein said lights are located near front end corners of said one shelf.

11. The display case of claim 9 wherein said means includes a lens having light directing portions.

12. The display case of claim 11 wherein said means further includes reflectors.

13. The display case of claim 9 wherein said means includes two light-directing portions and a focal point of each of said two light-directing portions is substantially coaxial with a longitudinal axis of a corresponding one of said lights.

14. The display case of claim 10 wherein said lights are mounted on said surrounding frame.

15. The display case of claim 11 wherein said lens provides a substantially uniform light distribution across said one shelf.

16. A display case used for displaying items, said display case comprising:

a surrounding frame;

lights mounted inside said display case;

shelves mounted inside said display case, at least one of said shelves having one of said lights mounted near each end thereof; and a lens mounted inside said display shelf and about one of said lights near one end of said one shelf in order to provide a more uniform light distribution over the length of said one shelf than would exist without said lens.

17. The display case of claim 16 wherein said one shelf has said lens near both ends thereof.

18. The display case of claim 16 wherein said lens includes light-directing portions.

19. The display case of claim 16 wherein said lights are fluorescent tubes.

20. The display case of claim 18 wherein said light-directing portions each have a focal point that is coaxial with a longitudinal axis of a corresponding one of said lights.

* * * * *